US005111186A

United States Patent [19]

Narlow et al.

[11] Patent Number: 5,111,186

[45] Date of Patent: May 5, 1992

[54] LC-TYPE ELECTRONIC ARTICLE SURVEILLANCE TAG WITH VOLTAGE DEPENDENT CAPACITOR

[75] Inventors: Doug Narlow, Coral Springs; Hubert A. Patterson, Boca Raton, both of Fla.

[73] Assignee: Sensormatic Electronics Corporation, Deerfield Beach, Fla.

[21] Appl. No.: 620,462

[22] Filed: Nov. 29, 1990

[51] Int. Cl.[5] ..... G08B 13/18

[52] U.S. Cl. ..... 340/572; 361/321

[58] Field of Search ..... 340/572; 361/321 R, 361/321 F, 321 P

[56] References Cited

U.S. PATENT DOCUMENTS 5,031,144 7/1991 Persky ..... 361/321

*Primary Examiner*—Glen R. Swann, III

*Attorney, Agent, or Firm*—Robin, Blecker, Daley & Driscoll

[57] ABSTRACT

A resonant tag for an article surveillance system comprising a voltage dependent capacitance means whose capacitance can be varied with changes in voltage to selectively provide one or more resonant frequencies for the resonant tag.

50 Claims, 4 Drawing Sheets

LC-TYPE ELECTRONIC ARTICLE SURVEILLANCE TAG WITH VOLTAGE DEPENDENT CAPACITOR

BACKGROUND OF THE INVENTION

This invention relates to tags for use in article surveillance systems and, in particular, to tags capable of being remotely disabled or deactivated and capable of exhibiting a unique signature.

One form of tag employed in present electronic article surveillance systems utilizes a high Q resonant inductor (L) -capacitor (C) circuit. In systems using this type of tag, typically a transmitter repetitively projects a swept RF field into a surveillance zone which is monitored by a receiver.

When an article carrying the resonant tag is placed in the surveillance zone, the tag causes a perturbation in the swept RF field when the frequency of the RF field approaches the resonant frequency of the tag. This perturbation is detected by the system receiver which activates various alarms, or other appropriate signals, to indicate the presence of the tag and, therefore, the article in the zone.

Since detection of a resonant tag is based upon receiving perturbations at a resonant frequency expected by the receiver, changing the resonant frequency of the tag effectively deactivates the tag. A variety of deactivating techniques for changing or altering the resonant frequency of a resonant tag have been used. In U.S. Pat. No. 4,063,229, issued on Dec. 13, 1977, to John Welsh and Richard N. Vaughn for "Article Surveillance", and assigned to the same assignee hereof, there is described a tag containing a semiconductor diode. To deactivate the tag, the semiconductor diode is burnt out by a relatively high power RF field which is inductively coupled to the tag. In U.S. Pat. No. 4,021,705, issued May 3, 1977, to George Jay Lichtblau for "Resonant Tag Circuits Having One Or More Fusible Links", there is described a resonant tag having one or more fusible links for altering the characteristics of the circuit. Each fusible link is able to be fused by a radiated high energy RF field of a predetermined frequency. The fusing of a fusible link changes the value of the inductance of the tag, thereby changing the resonant frequency and deactivating the tag.

Both of the aforesaid deactivation techniques require the use of a high energy RF field which may not be desirable in many applications. In U.S. Pat. No. 4,318,090, issued Mar. 2, 1982, to Douglas A. Narlow and Eugene Stevens for "Apparatus For Deactivating A Surveillance Tag", and also assigned to the same assignee hereof, there is described a wand like probe which contacts terminals on a resonant tag. The wand applies a low energy current through a diode of the tag, thereby destroying its unidirectional characteristics and changing the resonant characteristic of the tag. While the wand alleviates the need to use a high energy RF field, the wand can not be used to remotely deactivate the tag.

A further limitation of the above described resonant tags is that they are not capable of being restored to an active state after being deactivated. Therefore, a tag, upon deactivation, may not be used again.

The resonance effect exhibited by a tag can, in certain instances, occur in ordinary objects. Therefore, certain ordinary objects, placed within the surveillance zone, will cause perturbations in the RF field similar to those caused by resonant tags, thereby, resulting in a false alarm. This effect can be minimized by decreasing the range of frequencies over which the receiver initiates an alarm. However, this requires that the resonant frequency of each tag be more tightly controlled. To control the resonant frequency, high tolerance components and/or precision manufacturing techniques must be employed, thereby increasing the cost per tag.

It is, therefore, a primary object of the present invention to provide an improved resonant tag.

It is a further object of the present invention to provide a resonant tag that can be remotely deactivated by a low energy field.

It is still a further object of the present invention to provide a resonant tag that has a unique signature not readily reproduced in ordinary objects.

It is yet a further object of the present invention to provide a resonant tag having a signature which can be used as a code.

SUMMARY OF THE INVENTION

In accordance with the principles of the present invention, the above and other objectives are realized in a resonant tag comprising a voltage dependent capacitance means whose capacitance can be varied by a voltage change to vary the resonant frequency of the tag.

In the embodiment of the invention to be described hereinafter, the voltage dependent capacitance means has a first capacitance corresponding to a first resonant frequency for the tag when a voltage greater than a first threshold voltage is applied to the voltage dependent capacitance means and a second capacitance corresponding to a second resonant frequency for the tag when a voltage less than a second threshold voltage is applied to the voltage dependent capacitance means. In this way, by changing the applied voltage between the first and second voltages, the resonance of the tag can be changed between the first and second resonant frequencies.

In the disclosed embodiment, the voltage dependent capacitance means includes a ferroelectric dielectric which exhibits a first dielectric constant for voltages above the first threshold voltage and a second dielectric constant for voltages below the second threshold voltage. This results in the capacitance means exhibiting the first and second capacitances.

Also described are electronic article surveillance systems utilizing the resonant tag of the invention. In one disclosed system, the receiver of the system is tuned to the first resonant frequency of the tag and the tag is switched between its first and second resonant frequencies to activate and deactivate the tag. In a second system, a swept RF field is applied to the tag and is such that as the frequency is swept the voltage applied to the capacitance of the tag exceeds one of frequencies. This results in a unique response for the tag which is detected by the system receiver.

A further system is also disclosed in which the resonant tag includes a plurality of voltage dependent capacitive means having different threshold voltages.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
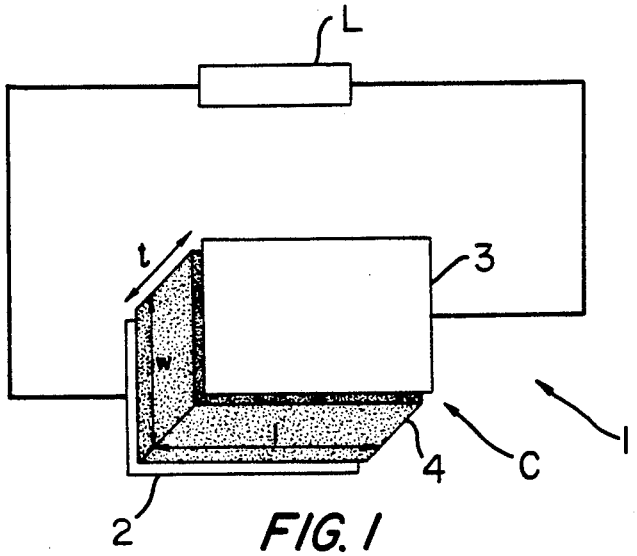
FIG. 1 shows a resonant tag in accordance with the principles of the present invention.

FIG. 1 shows a resonant tag 1 in accordance with the principles of the present invention. The tag 1 comprises a high Q resonant circuit formed by a capacitor C and an inducator L. The resonate frequency of the LC tag circuit is governed by the equation:

$$F_r = \frac{1}{2*\pi\,(LC)^{\frac{1}{2}}} \tag{1}$$

Where $F_r$=Resonant Frequency

As an example, for:

C=100 pf

L=3.127 uH $$F_r = \frac{1}{2*\pi\,(3.127\text{ uH}*100\text{ pf})^{\frac{1}{2}}}$$

$F_r$=9 MHz

The inducator L of the tag 1 may be of any construction. For example, the inducator may be a standard discrete inductor wound from wire or a printed series of concentric circles on a printed circuit board. The capacitor C of the tag 1 comprises a dielectric material 4 sandwiched between conductive plates 2 and 3. A first approximation of the capacitance of the capacitor C is based upon the equation $$C = \frac{K t_O A_d}{t} \tag{2}$$

Where:

l=length of dielectric contacting the conductive plate.

w=width of the dielectric contacting the conductive plate.

$A_d$=l * w=area of dielectric contacting the conductive plate.

K=the dielectric constant of the dielectric t=thickness of the dielectric $t_o$=Permittivity constant=$8.85\times10^{-12}$ F/M As an example, for:

l=58.3≦ w=58.3≦

$A_d$=l * w=3398.89 ≦$^2$

K=1000 t=3000 Å

C=100 pf

Combining equations 1 and 2, the resonant frequency $F_r$ of the LC circuit can be expressed as:

$$F_r = \frac{1}{2*\pi\,(LK\text{ to }A_d/t)^{\frac{1}{2}}} \tag{3}$$

As an example. for:

L=3.127 uH l=58.3 ≦ w=58.3 ≦

$A_d$=l * w=3398.89≦$^2$

K=1000 t=3000 Å

$F_r$=9 MHz

In accordance with the principles of the present invention, the dielectric 4 of the capacitor C is selected to have a dielectric constant which varies with voltage and, in particular, which, preferably, exhibits a first dielectric constant K1 for voltages increasing above a first threshold voltage and a second dielectric constant K2 for voltages decreasing below a second threshold voltage. Usable materials having such a dielectric characteristic are ferroelectric materials. A particularly advantageous ferroelectric material is lead zirconium titanate (PZT), since the dielectric constant of PZT changes upon the application of relatively low voltages (e.g., 2-10 volts) across the dielectric. Other usable dielectric materials are potassium nitrate, bismuth titanate and lead germanate.

Figure 2:
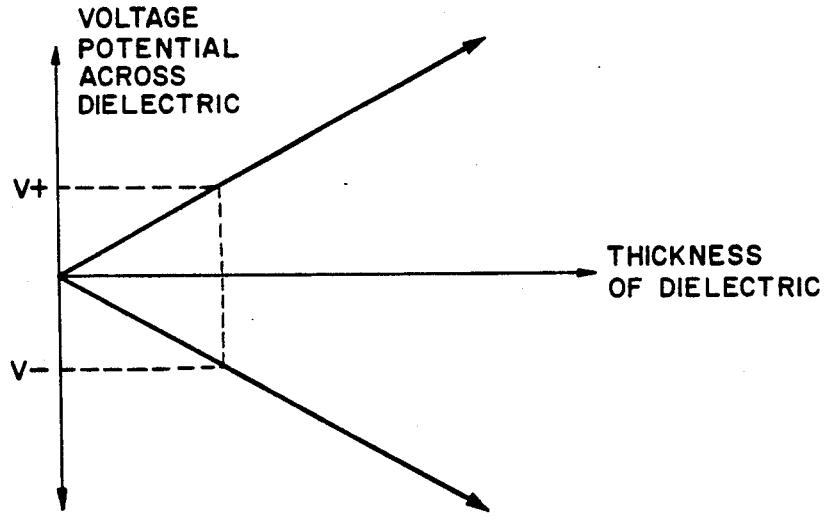
FIG. 2 illustrates the threshold voltage as a function of thickness for dielectrics usable in the capacitor of the tag of FIG. 1.

FIG. 2 is a representative graph illustrating the positive and negative voltage thresholds at which the dielectric constant of the dielectric 4 switches as a function of thickness t. In FIG. 2, the abscissa represents the thickness t and the ordinate represents the voltage V required across the dielectric 4 to switch its dielectric constant. As shown, for each dielectric thickness t, a threshold voltage V+ is required to ensure that the dielectric constant is at a first value. Similarly, for the same dielectric thickness, a negative threshold voltage V− is required to ensure that the dielectric constant is at a second value. For a PZT material of thickness 3000 Å, K1=600, K2=1200 and V±=5 volts.

Figure 3:
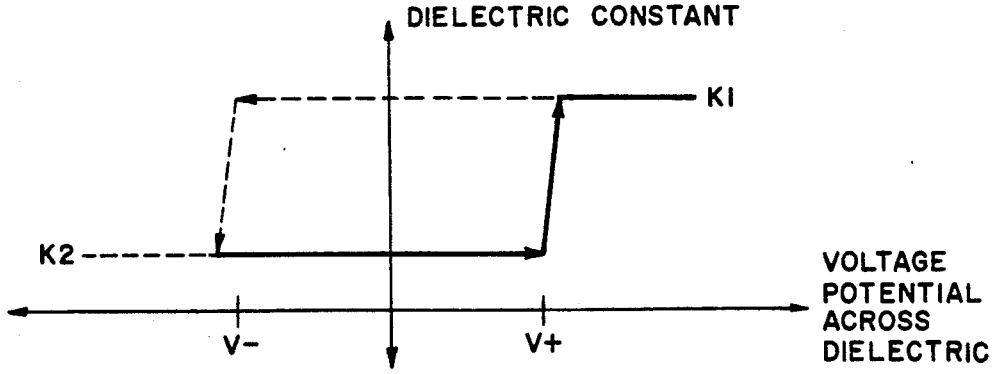
FIG. 3 illustrates the change in dielectric constant as a function of voltage for the dielectric of the capacitor of the tag of FIG. 1.

FIG. 3 is a graph illustrating the voltage potential across the conductive plates 2 and 3 of the capacitor C versus the dielectric constant value for the dielectric 4. Starting with a voltage potential exceeding V+, the dielectric constant is at a first value K1. As the voltage is reduced, the dielectric constant remains at K1 until a negative threshold voltage V− is reached. Upon reaching V−, the dielectric constant switches stepwise to a lower value K2. For all voltages below V−, the dielectric constant remains at K2. Thereafter, when increasing the voltage, the dielectric constant remains at K2 until the voltage reaches V+, at which time the dielectric constant switches stepwise to the higher value K1.

Since the capacitance of capacitor C is linearly related to the dielectric constant of the dielectric 4, the capacitance will follow a similar hysteresis type characteristic as that shown in FIG. 3 for the dielectric 4. The capacitance will thus switch between a first capacitance C1 and a second capacitance C2 at the thresholds V+ and V−.

As can be appreciated, the aforesaid voltage switching characteristic of the capacitor C, allows the resonant frequency of the LC circuit and therefore, the tag 1 to be switched between two values by temporarily applying a voltage equal to or greater than the threshold voltage V+ or equal to or less than the threshold voltage V− to the capacitor. For example, by temporarily applying a voltage potential greater than V+ a dielectric value of K1, capacitance C1 and resonance frequency $F_r1$ are obtained. Upon removing the voltage potential V+, K1 will remain as the dielectric constant until a negative voltage potential equal to or less than V− is applied, at which time the dielectric constant becomes K2, the capacitance C2 and resonant frequency $F_r2$.

Upon removing the voltage potential V−, K2 will remain as the dielectric constant until a voltage V+ is subsequently applied, at which time the dielectric constant, capacitance and resonant frequency return to K1, C1 and $F_r1$. As an example, for:

$$V > V+ \text{ therefore } K = K1 = 600$$

$l = 58.3 \leqq$
$w = 58.3 \leqq$
$A_d = l * w = 3398.89 \leqq^2$
$t = 3000$ Å
$F_r1 = 11.6$ MHz Further, for:

$$V < V- \text{ therefore } K = K2 = 1200$$

$l = 58.3 \leqq$
$w = 58.3 \leqq$
$A_d = l * w = 3398.89 \leqq^2$
$t = 3000$ Å
$F_r2 = 8.2$ MHz With the tag 1 configured as described above, the different resonant frequencies of the tag can be associated with activated and deactivated states of the tag in an electronic article surveillance system. Thus, to activate the tag 1, the tag can be subjected to a field which results in a voltage of V+ across the capacitor C, providing a tag resonant frequency $F_r1$. When the tag is then placed in a surveillance zone, it will resonate when an RF field at the frequency $F_r1$ is transmitted into the zone. This will cause a perturbation to the field which can be sensed by the system receiver, which can then sound an alarm indicating the presence of the tag and the associated article.

To deactivate the tag 1, the tag can be subjected to an applied field of V−, causing the tag resonant frequency to now switch to frequency $F_r2$. As a result, the tag 1 will no longer cause a perturbation of the applied field at $F_r1$ in the surveillance zone, because its resonance is now at $F_r2$. The tag 1 and associated article will thus pass through the zone without detection and without causing an alarm.

Figure 4:
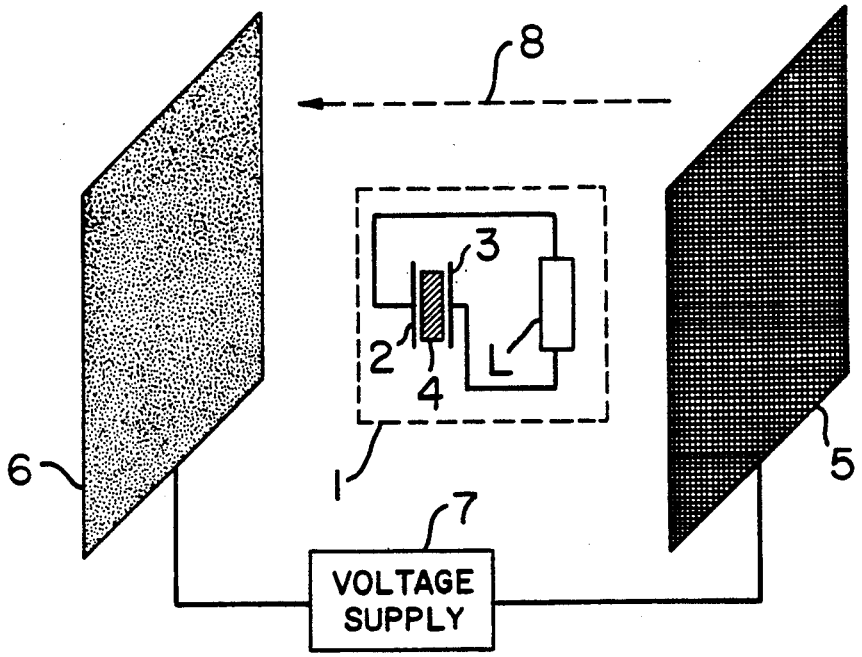
FIGS. 4 and 5 illustrate respective activation and deactivation devices for the tag of FIG. 1.

FIG. 4 illustrates a technique for activating the tag 1 utilizing an electrostatic field 8 formed between plates 5 and 6. Voltage supply 7 applies a positive voltage to plate 5 with respect to the voltage applied to plate 6. When tag 1 is placed within the electrostatic field 8, a voltage differential is induced across the conductive plates 2 and 3. The conductive plate 3 thus develops a positive voltage with respect to conductive plate 2. By increasing the electrostatic field 8 until the voltage differential developed reaches the threshold voltage V+ discussed above, the dielectric constant switches to K1 and, therefore, the capacitance and resonant frequency of the tag 1 switch to C1 and $F_r1$, respectively. Upon removing the tag 1 from the electrostatic field 8, the tag remains active due to the hysteresis characteristic discussed previously.

Figure 5:
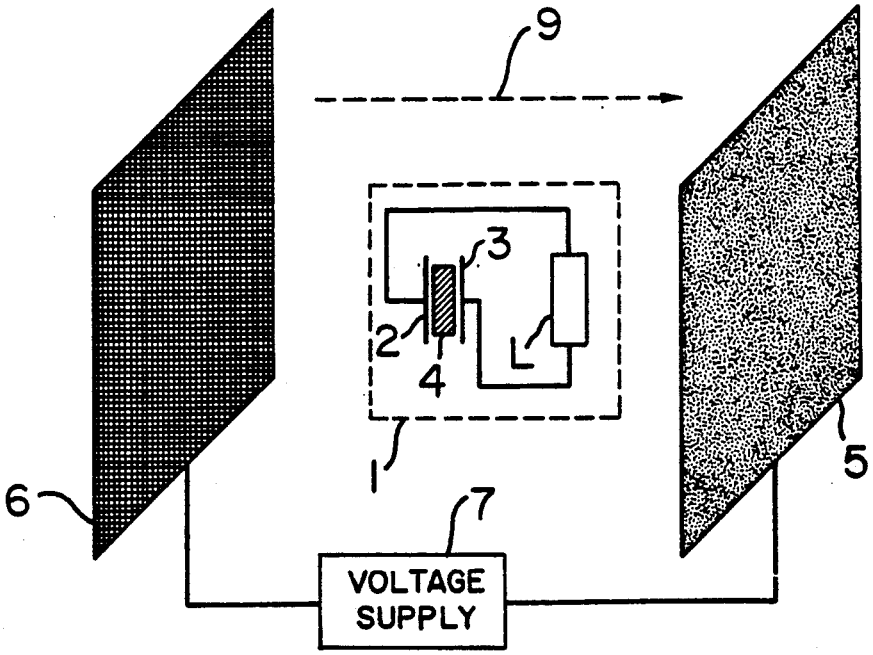

In FIG. 5, the tag 1 is deactivated by an electrostatic field 9 formed between plates 5 and 6. In this case, voltage supply 7 applies a positive voltage to plate 6 with respect to the voltage applied to plate 5, causing conductive plate 3 to develop a negative voltage with respect to conductive plate 2. By increasing the electrostatic field 9 until the voltage differential reaches V−, the dielectric constant switches to K2 and, therefore, the capacitance and resonant frequency of the tag 1 switch to C2 and $F_r2$. The tag 1 is thus deactivated and remains deactivated upon removing the tag 1 from the electrostatic field 9, due to the hysteresis characteristic.

While activation and deactivation of the tag 1 have been illustrated using an electrostatic field, other types of mechanisms can also be used. Thus, a high voltage pulse of appropriate polarity may be generated and propagated by an antenna to the conductive plates, to provide the threshold voltages.

Figure 6:
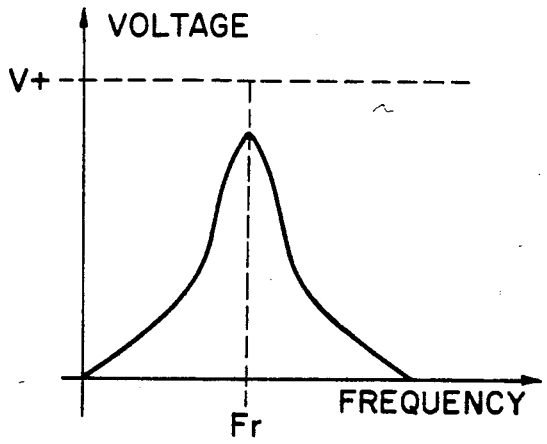
FIGS. 6 and 7 show the voltage across the capacitor of the tag of FIG. 1, as a function of the frequency of a swept RF field.

When the resonant tag 1 of FIG. 1 is placed within an external swept RF field, the voltage, as measured between conductive plates 2 and 3 of the capacitor C varies with the frequency of the swept RF field. FIG. 6 is a typical curve showing this voltage as a function of the swept RF frequency. As the RF swept frequency approaches the resonant frequency $F_r$, the voltage across the capacitor increases. The maximum voltage is reached when the RF swept frequency equals $F_r$. Thereafter, as the RF swept frequency is increased beyond $F_r$, the voltage across the capacitor decreases.

Figure 7:
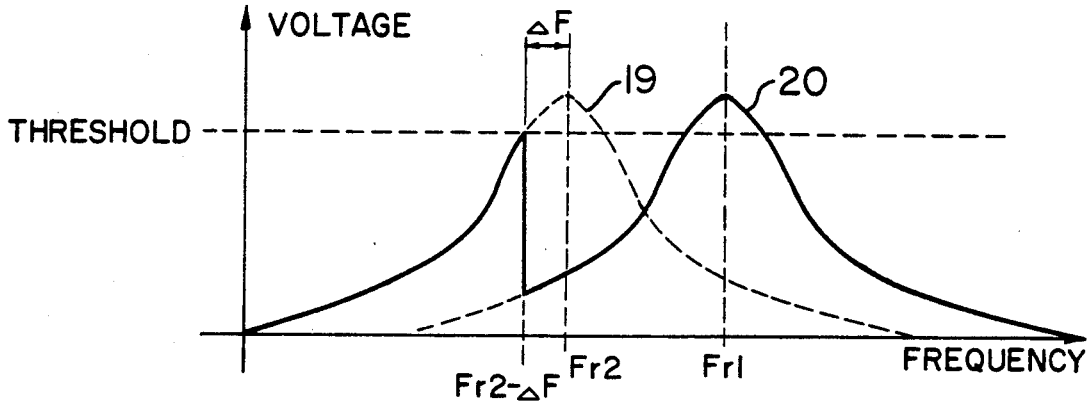

In the discussion of FIG. 6, it was assumed that the voltage threshold for switching the dielectric constant of the capacitor C of the tag 1 was not reached during the RF frequency sweep. Therefore, the dielectric constant of the capacitor and the resonant frequency of the tag remained constant. However, by adapting the tag and field such that the switching voltage threshold is exceeded as the RF field is swept, the voltage characteristic of the capacitor C and, therefore, the tag 1 becomes unique. This, in turn, provides a unique signature for the tag, whereby it can be readily discernible in an electronic article surveillance system. FIG. 7 shows the tag 1 adapted so that the threshold for switching of the tag is exceeded during the RF sweep.

In FIG. 7, curve 19 represents the voltage across the capacitor C as a function of an RF swept field frequency for the the tag 1 at the resonant frequency of $F_r2$. Similarly, curve 20 represents the voltage across the tag when operating at its resonant frequency of $F_r1$. As shown, as the RF frequency increases towards $F_r2$, the voltage increases accordingly. At a frequency $F_r2-$ F the voltage across the capacitor C reaches the threshold V+ for dielectric switching. The dielectric constant of the capacitor thereby changes, changing the resonant frequency to $F_r1$. The voltage across the capacitor quickly drops to, and subsequently follows, the curve 20 for the resonant frequency $F_r1$.

As can be appreciated, the above step change in resonance of the tag 1 during the RF sweep in frequency, provides a unique characteristic for the tag 1 which is not commonly found in other materials. As a result, the characteristic provides a unique signature for the tag 1. This, in turn, affords a high degree of confidence that the signal generated by the tag is not a signal generated by other objects. Thus, use of the tag 1 in an electronic article surveillance system using swept RF frequency detection, results in a highly reliable system where the potential for false alarms is greatly reduced.

Figure 8:
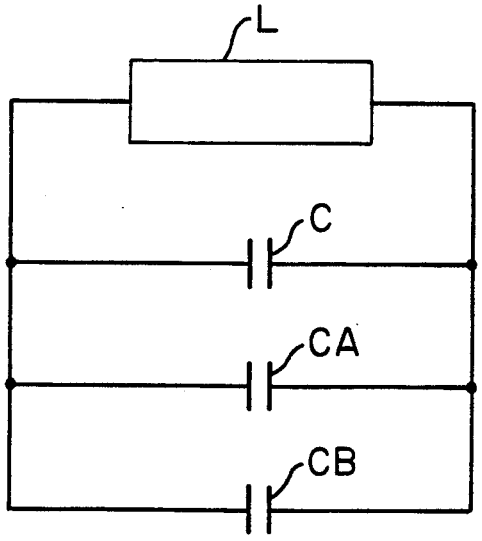
FIG. 8 shows a further resonant tag in accordance with the principles of the present invention.

FIG. 8, shows a further embodiment of the present invention in which the resonant LC tag 1 includes two additional capacitors CA, CB connected in parallel with the capacitor C. In accordance with the invention, the capacitors CA, CB have ferroelectric dielectrics whose thicknesses t are different from each other and from that of the dielectric of the capacitor C. Therefore, each capacitor has different threshold voltages at which its dielectric constant switches (see FIG. 2).

For the illustrative tag of FIG. 8, the dielectric thickness t for C is less than the thickness t for CA which, in turn, is less than the thickness t for CB. Therefore, the threshold voltage V+ for the dielectric in C is less than the threshold voltage V+A for the dielectric in CA which in turn is less than the threshold voltage V+B for the dielectric in CB. The resonant frequency, at various voltages can be expressed as:

$$\text{For } V < V+ \; F_{r1} = \frac{1}{2*\pi\,((C + CA + CB)*L)^{\frac{1}{2}}}$$

$$\text{For } V+ < V < V + A \; F_{r2} = \frac{1}{2*\pi\,((C' + CA + CB)*L)^{\frac{1}{2}}}$$

$$\text{For } V + A < V < V + B \; F_{r3} = \frac{1}{2*\pi\,((C' + CA' + CB)*L)^{\frac{1}{2}}}$$

$$\text{For } V + B < V \; F_{r4} = \frac{1}{2*\pi\,((C' + CA' + CB')*L)^{\frac{1}{2}}}$$

where:

C, CA, CB = the capacitance before respective voltage threshold reached.

C', CA', CB' = the capacitance after respective voltage threshold reached.

Figure 9:
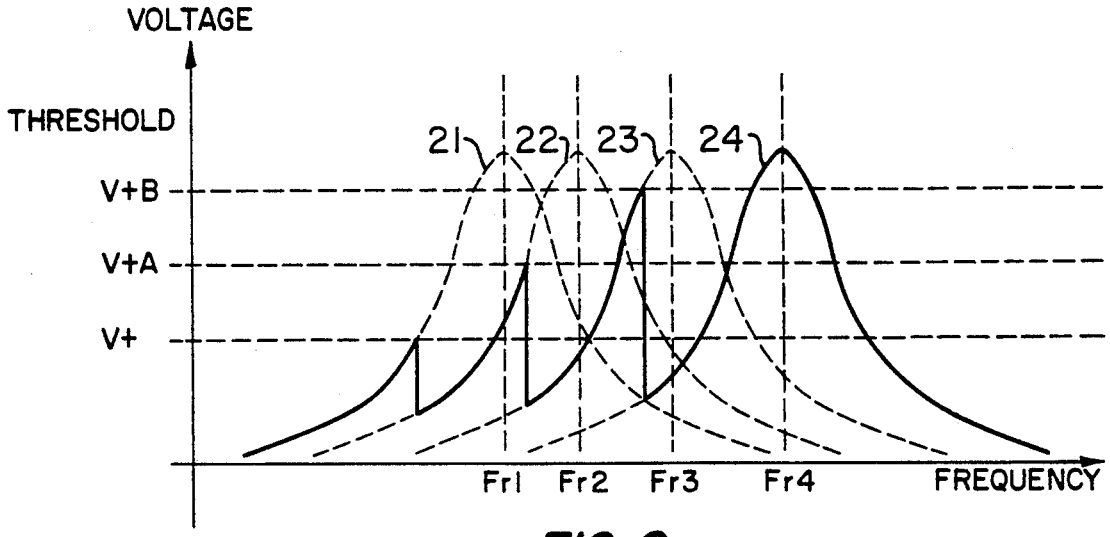
FIG. 9 shows the voltage versus frequency response for the tag of FIG. 8.

FIG. 9 is a graph showing the voltage across the capacitors of the tag 1 of FIG. 8 as a function of an RF swept frequency. Curves 21–24 show the voltage versus frequency response for LC circuits having resonance frequencies $F_{r1}$–$F_{r4}$, respectively. At the lower frequencies, the voltage across the capacitors is below the threshold values V+, V+A and V+B of capacitors C, CA and CB, respectively. Therefore, the resonant frequency is $F_{r1}$. As the frequency increases, the voltage increases in accordance with the first curve 21 until threshold voltage V+ is reached. Upon reaching V+, the first capacitor C changes to a value of C', and therefore, the resonant frequency changes to $F_{r2}$. The voltage drops sharply so as to follow curve 22. As the frequency further increases, the voltage increases in accordance with curve 22, until threshold voltage V+A is reached. Upon reaching V+A, the second capacitor CA changes to a value of CA', and therefore, the resonant frequency changes to $F_{r3}$. The voltage drops sharply so as to follow curve 23. As the frequency still further increases, the voltage increases in accordance with curve 23, until threshold voltage V+B is reached. Upon reaching V+B, the third capacitor CB changes to a value of CB', and therefore, the resonant frequency changes to $F_{r4}$. The voltage drops sharply so as to follow curve 24. Thereafter, as the frequency continues to increase, the voltage continues to change in accordance with curve 24.

The swept frequency characteristic of the tag 1 of FIG. 8 thus has a plurality of step changes which are unique to the tag and which can be used to identify not only the presence of an article but the type of article. Furthermore, by adding or deleting capacitors different codes can be realized and associated with different articles in an overall electronic article surveillance system.

The tag of FIG. 8 comprises a single inductor and multiple capacitors having varying threshold voltages. However, the present invention is not limited to such construction. A tag having multiple resonant LC circuits, each resonant circuit containing at least one voltage dependent capacitor as above-described can also be used to form the tag and develop the coded, unique characteristic.

Figure 10:
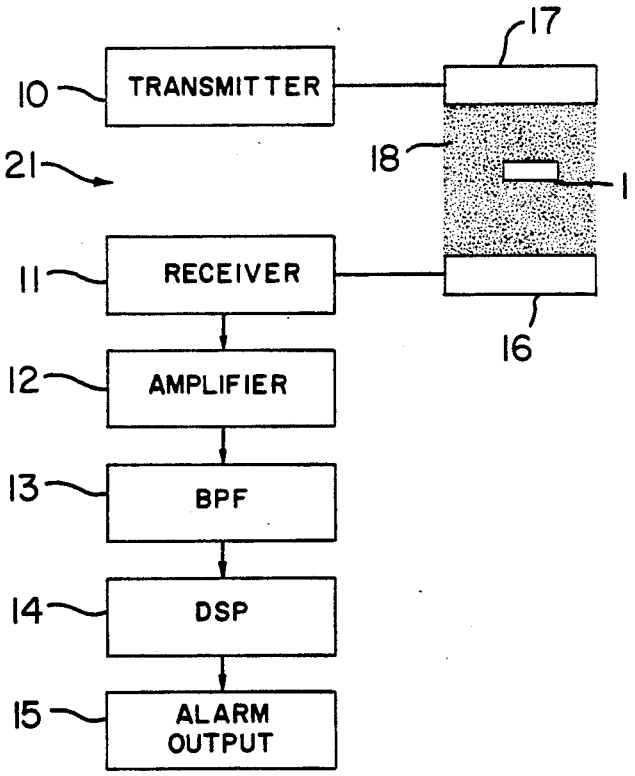
FIG. 10 illustrates an electronic article surveillance system for use with the resonant tags of the invention.

FIG. 10 shows an electronic article surveillance system 21 usable to detect the tags 1 of the invention in a surveillance zone 18. The transmitter 10 generates a swept RF field which is radiated by an antenna 17. The receiver 11, detects through an antenna 16 perturbations to the field. The received signals are then amplified in amplifier 12 and filtered by a band pass filter 13. Digital signal processing 14 is then performed to determine whether an active tag 1 is present within the zone. If it is determined that an active tag is present, an alarm is initiated by the alarm 15.

It should be noted that the tags of the present invention are usable in a frequency range from about 1 to 15 MHz.

In all cases it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A resonant tag adapted for use in an electronic article surveillance system, said resonant tag having at least a first resonant frequency, the resonant tag comprising:

an inductive means:

and a voltage dependent capacitance means whose capacitance can be varied with changes in voltage to selectively provide said first resonant frequency for said tag.

2. A resonant tag in accordance with claim 1, wherein:

said voltage dependent capacitance means has a first capacitance value when voltages equal or greater than a first threshold voltage are applied to said voltage dependent capacitance means and a second capacitance value when voltages equal to or less than a second threshold voltage are applied to said voltage dependent capacitance means, said second threshold voltage being lower than said first threshold voltage and said first capacitance value resulting in said tag having said first resonant frequency and said second capacitance value resulting in said tag having a second resonant frequency.

3. A resonant tag in accordance with claim 2, wherein:

said voltage dependent capacitance means includes a dielectric whose dielectric constant is at a first dielectric constant value when voltages equal to or greater than said first threshold voltage are applied to said voltage dependent capacitance means and at a second dielectric constant value when voltages equal to or less than said second threshold voltage are applied to said voltage dependent capacitance means, said first and second dielectric constants resulting in said first and second capacitances.

4. A resonant tag in accordance with claim 3 wherein:
said dielectric constant of said dielectric remains at said first dielectric constant value as the voltages applied to said capacitance means decrease from above said first threshold voltage to said second threshold voltage at which said dielectric constant undergoes substantially a step change to said second dielectric constant value;
and said dielectric constant of said dielectric remains at said second dielectric constant value as the voltage applied to said capacitance means increases from below said second threshold value to said first threshold value at which said dielectric constant undergoes substantially a step change to said first dielectric constant value.

5. A resonant tag in accordance with claim 2 wherein:
the capacitance of said capacitance means remains at said first capacitance value as the voltage applied to said capacitance means decreases from above said first threshold voltage to said second threshold voltage at which said capacitance of said capacitance means undergoes substantially a step change to said second capacitance value;
and the capacitance of said capacitance means remains at said second capacitance value as the voltage applied to said capacitance increases from below said second threshold value to said first threshold value at which said capacitance of said capacitance means undergoes substantially a step change to said first capacitance value.

6. A resonant tag in accordance with claim 2, wherein:
said voltage dependent capacitance means comprises: a capacitor having a ferroelectric dielectric.

7. A resonant tag in accordance with claim 6, wherein:
said ferroelectric dielectric is Lead Zirconium Titanate.

8. A resonant tag in accordance with claim 2, wherein:
said first resonant frequency indicates that said tag is activated and said second resonant frequency indicates that said tag is deactivated.

9. A resonant tag in accordance with claim 2, wherein:
said second resonant frequency indicates that said tag is activated and said first resonant frequency indicates that said tag is deactivated.

10. A resonant tag in accordance with claim 1 further comprising:
one or more further voltage dependent capacitance means having capacitances which can be varied with changes in voltage to selectively provide one or more further resonant frequencies for said tag.

11. A resonant tag in accordance with claim 10 wherein:
each of said voltage dependent capacitance means has a first capacitance value when voltages equal to or greater than a first threshold voltage are applied to that voltage dependent capacitance means and a second capacitance value when voltages equal to or less than a second threshold voltage are applied to that voltage dependent capacitance means, said second threshold voltage being lower than said first threshold voltage.

12. A resonant tag in accordance with claim 11 wherein:
the first threshold voltages associated with said voltage dependent capacitance means are different.

13. A resonant tag in accordance with claim 12 wherein:
the second threshold voltages associated with said voltage dependent capacitance means are different.

14. A resonant tag in accordance with claim 11 wherein:
the second threshold voltages associated with said voltage dependent capacitance means are different.

15. A resonant tag in accordance with claim 11 wherein:
each of said voltage dependent capacitance means comprises a capacitor having a ferroelectric dielectric.

16. A resonant tag in accordance with claim 15 wherein:
said ferroelectric dielectric is lead zirconium titanate.

17. An article surveillance system, comprising:
a resonant tag comprising: an inductive means, and a voltage dependent capacitance means whose capacitance can be varied with changes in voltage to selectively provide a first resonant frequency for said tag; and
means for detecting said resonant tag.

18. An article surveillance system in accordance with claim 17, wherein:
said detecting means is arranged to detect said resonant tag only when said tag exhibits said first resonant frequency.

19. An article surveillance system in accordance with claim 17 further comprising:
an alarm responsive to said detecting means.

20. An article surveillance system in accordance with claim 17, wherein:
said means for detecting comprises: means for transmitting an RF field into a surveillance zone; and means for sensing perturbations to said field in said zone.

21. An article surveillance system in accordance with claim 20 wherein:
said field is an RF swept field.

22. An article surveillance system in accordance with claim 20 wherein:
said voltage dependent capacitance means has a first capacitance value for voltages equal to or greater than a first threshold voltage applied to said voltage dependent capacitance means and a second capacitance value for voltages equal to or less than a second threshold voltage applied to said voltage dependent capacitance means; said first capacitance value resulting in said tag having said first resonant frequency and said second capacitance value resulting in said tag having a second resonant frequency.

23. An article surveillance system in accordance with claim 22, further comprising:
means for applying a voltage equal to or greater than said first threshold voltage to said voltage dependent capacitance means,; and
means for applying a voltage equal to or less than said second threshold voltage to said voltage dependent capacitance means.

24. An article surveillance system in accordance with claim 22, wherein:
said means for detecting perturbations to said field detects perturbations at said first and said second resonant frequencies.

25. An article surveillance system in accordance with claim 22, wherein:

said voltage dependent capacitance means comprises: a capacitor having a ferroelectric dielectric.

26. An article surveillance system in accordance with claim 25, wherein:

said ferroelectric dielectric is lead zirconium titanate.

27. An article surveillance system in accordance with claim 22, wherein:

one of said first and second resonant frequencies is indicative of an activated state for said tag and the other of said first and second resonant frequencies is indicative of a deactivated state for said tag.

28. An article surveillance system in accordance with claim 20; wherein:

said tag further comprises: one or more further voltage dependent capacitance means having capacitance which can be varied with changes in voltage to selectively provide one or more further resonant frequencies for said tag.

29. An article surveillance system in accordance with claim 28, wherein:

each of said voltage dependent capacitance means has a first capacitance value when voltages equal to or greater than a first threshold voltage are applied to that voltage dependent capacitance means and a second capacitance value when voltages equal to or less than a second threshold voltage are applied to that voltage dependent capacitance means.

30. An article surveillance system in accordance with claim 29, wherein:

the first threshold voltages associated with said voltage dependent capacitance means are different.

31. An article surveillance system in accordance with claim 30, wherein:

the second threshold voltages associated with said voltage dependent capacitance means are different.

32. An article surveillance system in accordance with claim 29, wherein the second threshold voltages associated with said voltage dependent capacitance means are different.

33. An article surveillance system in accordance with claim 29, wherein each of said voltage dependent capacitance means comprises a capacitor having a ferroelectric dielectric.

34. An article surveillance system in accordance with with claim 29, wherein:

the RF field is a swept RF Field.

35. A resonant tag adapted for use in an electronic article surveillance system, said tag comprising a circuit having at least a first resonant frequency, the circuit comprising:

an inductive means:

and a voltage dependent capacitance means whose capacitance can be varied with changes in voltage to selectively provide said first resonant frequency for said tag.

36. A circuit in accordance with claim 35, wherein:

said voltage dependent capacitance means has a first capacitance value when voltages equal or greater than a first threshold voltage are applied to said voltage dependent capacitance means and a second capacitance value when voltages equal to or less than a second threshold voltage are applied to said voltage dependent capacitance means, said second threshold voltage being lower than said first threshold voltage and said first capacitance value resulting in said circuit having said first resonant frequency and said second capacitance value resulting in said circuit having a second resonant frequency.

37. A circuit in accordance with claim 36, wherein:

said voltage dependent capacitance means includes a dielectric whose dielectric constant is at a first dielectric constant value when voltages equal to or greater than said first threshold voltage are applied to said voltage dependent capacitance means and at a second dielectric constant value when voltages equal to or less than said second threshold voltages are applied to said voltage dependent capacitance means, said first and second dielectric constants resulting in said first and second capacitances.

38. A circuit in accordance with claim 37 wherein:

said dielectric constant of said dielectric remains at said first dielectric constant value as the voltages applied to said capacitance means decrease from above said first threshold voltage to said second threshold voltage at which said dielectric constant undergoes substantially a step change to said second dielectric constant value;

and said dielectric constant of said dielectric remains at said second dielectric constant value as the voltage applied to said capacitance means increases from below said second threshold value to said first threshold value at which said dielectric constant undergoes substantially a step change to said first dielectric constant value.

39. A circuit in accordance with claim 36 wherein:

the capacitance of said capacitance means remains at said first capacitance value as the voltage applied to said capacitance means decreases from above said first threshold voltage to said second threshold voltage at which said capacitance of said capacitance means undergoes substantially a step change to said second capacitance value;

and the capacitance of said capacitance means remains at said second capacitance value as the voltage applied to said capacitance increases from below said second threshold value to said first threshold value at which said capacitance of said capacitance means undergoes substantially a step change to said first capacitance value.

40. A circuit in accordance with claim 36, wherein:

said voltage dependent capacitance means comprises: a capacitor having a ferroelectric dielectric.

41. A circuit in accordance with claim 40, wherein:

said ferroelectric dielectric is lead zirconimum titanate.

42. A circuit in accordance with claim 36, wherein:

said first resonant frequency indicates that said circuit is activated and said second resonant frequency indicates that said circuit is deactivated.

43. A circuit in accordance with claim 36, wherein:

said second resonant frequency indicates that said circuit is activated and said first resonant frequency indicates that said tag is deactivated.

44. A circuit in accordance with claim 35 further comprising:

one or more further voltage dependent capacitance means having capacitances which can be varied with changes in voltage to selectively provide one or more further resonant frequencies for said circuit.

45. A circuit in accordance with claim 44 wherein:

each of said voltage dependent capacitance means has a first capacitance value when voltages equal to or greater than a first threshold voltage are applied to that voltage dependent capacitance means and a second capacitance value when voltages equal to or less than a second threshold voltage are applied to that voltage dependent capacitance means, said second threshold voltage being lower than said first threshold voltage.

46. A circuit in accordance with claim 45 wherein: the first threshold voltages associated with said voltage dependent capacitance means are different.

47. A circuit in accordance with claim 46 wherein: the second threshold voltages associated with said voltage dependent capacitance means are different.

48. A circuit in accordance with claim 45 wherein: the second threshold voltages associated with said dependent capacitance means are different.

49. A circuit in accordance with claim 45 wherein: each of said voltage dependent capacitance means comprises a capacitor having a ferroelectric dielectric.

50. A circuit in accordance with claim 49 wherein: said ferroelectric dielectric is lead zirconium titanate.

* * * * *

UNITED STATES PATENT AND TRADEMARK OFFICE

CERTIFICATE OF CORRECTION

PATENT NO. : 5,111,186

DATED : May 5, 1992

INVENTOR(S) : Doug Narlow, et al.

It is certified that error appears in the above-identified patent and that said Letters Patent is hereby corrected as shown below:

Col. 2, line 57. After "of" insert -- the voltage thresholds, causing the tag to switch resonant --

Col. 3, lines 25, 41, 42. Change "inducator" to -- inductor --

Col. 3, line 54. Change "1=length" to -- $\ell$= length --

Col. 3, lines 58, 66. Change "1*W" to -- $\ell$*W --

Col. 3, line 64. Change "1=58.3" to -- $\ell$=58.3 --

Col. 4, line 11. Change "1=58.3" to -- $\ell$=58.3 --

Col. 4, line 13. Change "1*W" to -- $\ell$*W --

Col. 5, lines 20, 28. Change "1=58.3" to -- $\ell$=58.3 --

Col. 5, lines 23, 30. Change "1*W" to -- $\ell$*W --

Col. 6, line 49. Delete "the" first occurrence --

Col. 6, line 54. Change "F" to -- $^{A}F$ --

Col. 10, line 60. Change "means,;" to -- means; --

Col. 11, line 61. After "equal" insert -- to --

Signed and Sealed this

Thirteenth Day of July, 1993

*Attest:*

Michael K. Kirk

MICHAEL K. KIRK

*Attesting Officer*

*Acting Commissioner of Patents and Trademarks*